US008166581B2

(12) United States Patent
Lovatt

(10) Patent No.: US 8,166,581 B2
(45) Date of Patent: May 1, 2012

(54) TOILET DEVICE

(75) Inventor: Christopher Lovatt, Pew Shan (GB)

(73) Assignees: Alan Frederick Sandy, Tiverton (GB); Gillian Paula Wright, Buckinghamshire (GB)

( * ) Notice: Subject to any disclaimer, the term of this patent is extended or adjusted under 35 U.S.C. 154(b) by 416 days.

(21) Appl. No.: 12/311,392

(22) PCT Filed: Sep. 6, 2007

(86) PCT No.: PCT/GB2007/050526

§ 371 (c)(1),
(2), (4) Date: May 4, 2009

(87) PCT Pub. No.: WO2008/038036

PCT Pub. Date: Apr. 3, 2008

(65) Prior Publication Data

US 2009/0320194 A1 Dec. 31, 2009

(30) Foreign Application Priority Data

Sep. 29, 2006 (GB) ..... 0619171.2

(51) Int. Cl.
*A47K 11/06* (2006.01)

(52) U.S. Cl. ..... 4/484

(58) Field of Classification Search ..... 4/483–484
See application file for complete search history.

(56) References Cited

U.S. PATENT DOCUMENTS

| | | | |
|---|---|---|---|
| 3,235,884 | A | 2/1966 | Rehsteiner |
| D209,568 | S | 12/1967 | De Castro |
| D271,614 | S | 11/1983 | Martin |
| 5,155,871 | A | 10/1992 | Sams |
| 5,161,263 | A | 11/1992 | Geneve et al. |
| D340,512 | S | 10/1993 | Geneve et al. |
| 5,974,598 | A | 11/1999 | Granda-Cabrera |
| 6,341,386 | B1 | 1/2002 | Phillips et al. |
| D583,032 | S | 12/2008 | Lovatt |

FOREIGN PATENT DOCUMENTS

| | | | |
|---|---|---|---|
| DE | 298 04 697 | U1 | 5/1998 |
| DE | 29804697 | U1 | 7/1998 |
| EP | 0 427 731 | A | 5/1991 |
| EP | 0 427 731 | B1 | 5/1991 |
| GB | 676701 | | 7/1952 |
| GB | 1 221 586 | | 2/1971 |
| GB | 2 184 650 | A | 7/1987 |
| WO | WO 89/11317 | | 11/1989 |

OTHER PUBLICATIONS

International Search Report for priority PCT Application No. PCT/GB2007/050526, dated Apr. 9, 2009.
International Search Report, dated Jan. 29, 2008, corresponding to PCT/GB2007/050526.
Written Opinion of the International Searching Authority, dated Jan. 29, 2008, corresponding to PCT/GB2007/050526.
British Search Report, dated Jan. 11, 2007, corresponding to GB0619171.2.

*Primary Examiner* — Charles Phillips
(74) *Attorney, Agent, or Firm* — Christie, Parker & Hale, LLP

(57) ABSTRACT

A toilet device includes a seat (2) with a pair of side walls (14 & 16) pivotally connected thereto. The side walls are capable of three configurations with respect to the seat portion (2). In a first folded configuration they extend towards one another for compact storage of the device. In a second configuration they extend downwardly in right angles to the seat for use as a chamber pot when supplied with a suitable liner. In a third configuration the side walls extend outwardly away from one another so that the device can be placed on a conventional toilet seat and adapt that seat to the user of the device. Locking and locating means are provided for locking and/or locating the device in the three configurations.

10 Claims, 6 Drawing Sheets

TOILET DEVICE

CROSS-REFERENCE TO RELATED APPLICATION

This application is a National Phase Patent Application and claims the priority of International Application Number PCT/GB2007/050526, filed on Sep. 6, 2007, which claims priority of British Patent Application Number 0619171.2, filed on Sep. 29, 2006.

The present invention relates to a toilet device. European Patent No 0427731 describes a portable chamber pot or potty for a small child or toddler. The potty comprises a seat portion sized to accommodate the bottom of a small child or toddler and pair of arcuate legs to support the seat portion above the ground. The legs can be folded inwardly for compact storage.

A disposable container in the form of a plastic bag with a pair of handles can be draped over the seat portion and shaped to form a receptacle below the seat portion with the handles hooked over the legs to hold the receptacle in place.

This portable chamber pot does not lend itself for use in combination with a conventional toilet pan.

It is an object to provide an improved toilet device.

According to the present invention there is provided a toilet device comprising a seat portion, a pair of side walls pivotally secured to opposite sides of the seat portion so that the side walls can be displaced from a first configuration in which they face inwardly towards each other, through a second configuration in which they extend generally at right angles to the seat portion to a third configuration in which they extend away from one another, locking means for locking the side walls to the seat portion in the second configuration and stop means for preventing the side walls from pivoting beyond the third configuration.

A toilet device embodying the invention will now be described, by way of example with reference to the accompanying drawings in which, FIG. 1 is a perspective view of the device in its free standing potty configuration;

Figure 1:
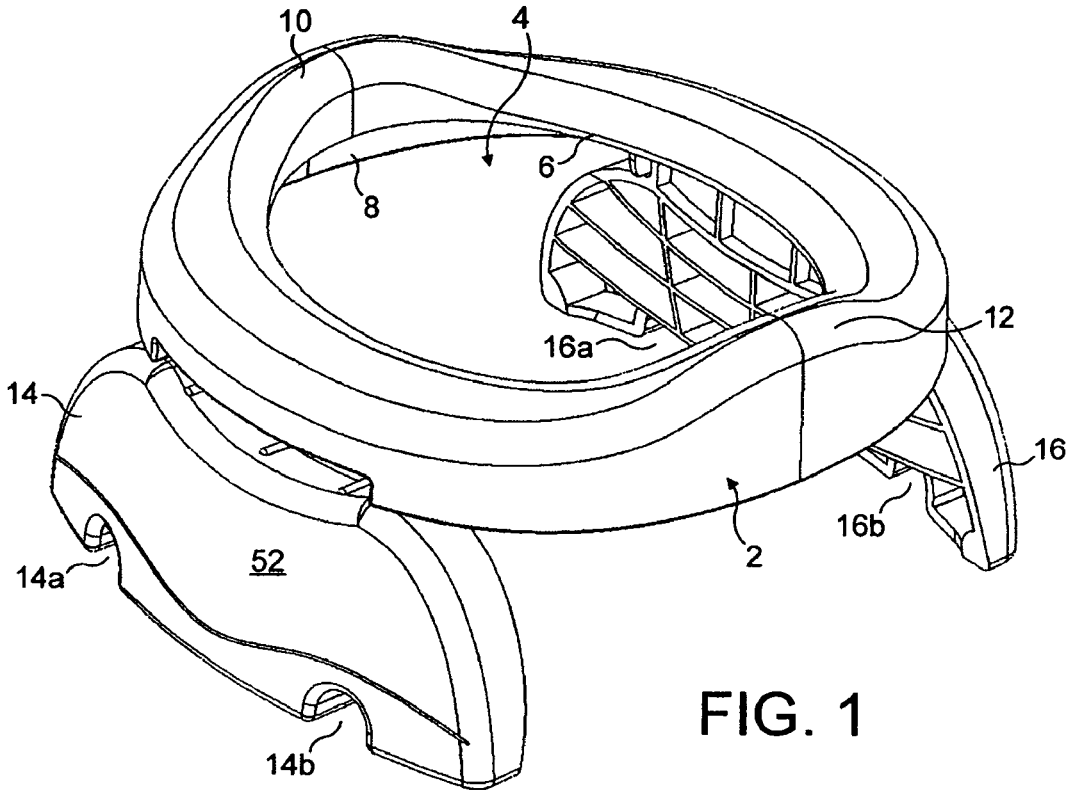
Figure 2:
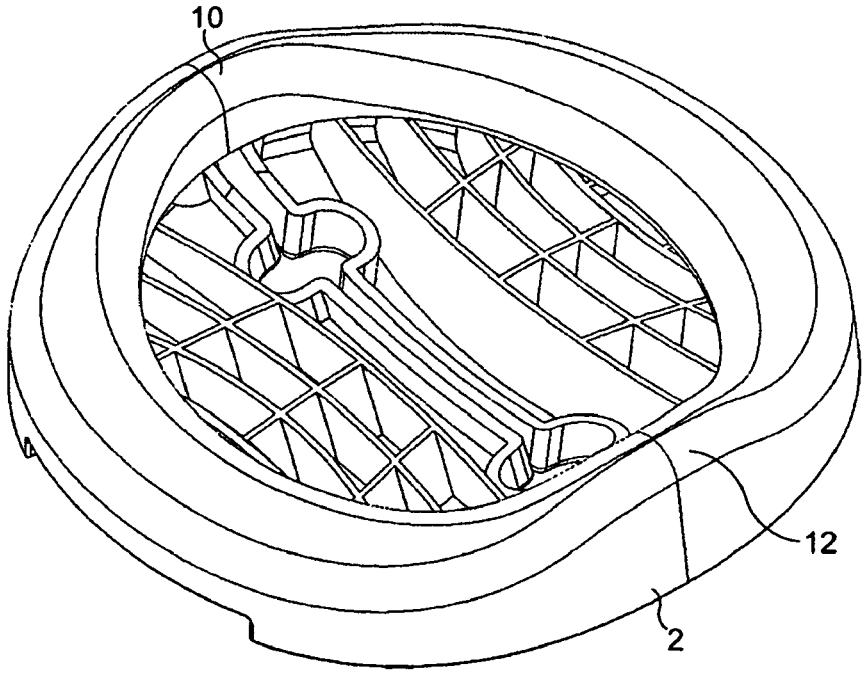
FIG. 2 is a perspective view of the device in its folded away configuration.
Figure 3:
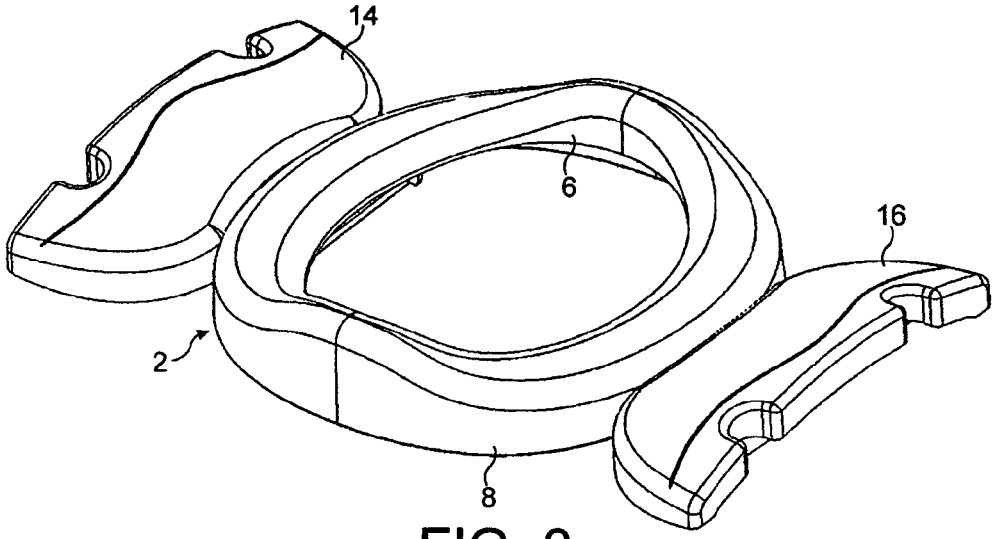
FIG. 3 is a perspective view of the device in its toilet seat converter configuration.
Figure 4:
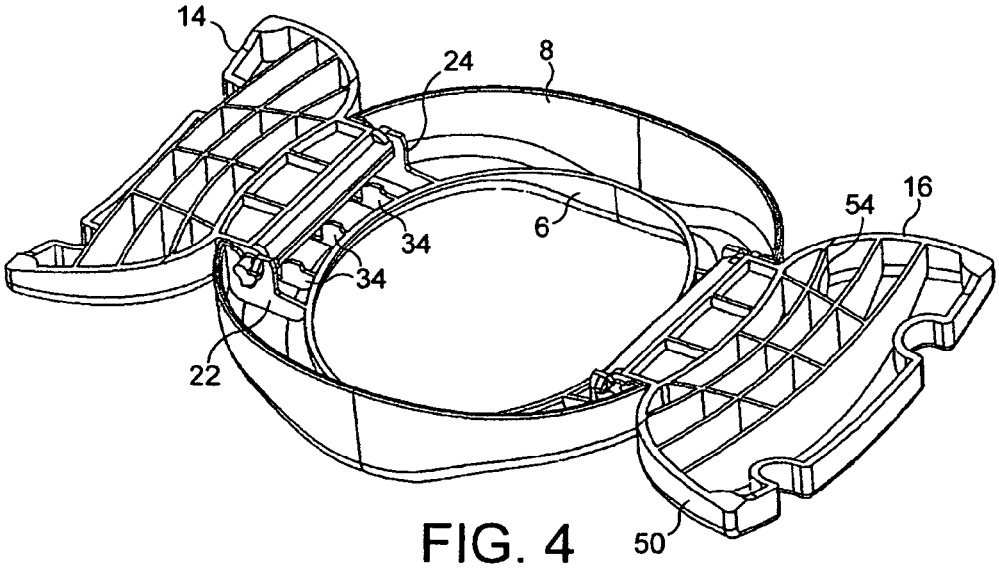
FIG. 4 is a perspective view of the device of FIG. 3 from below.
Figure 5:
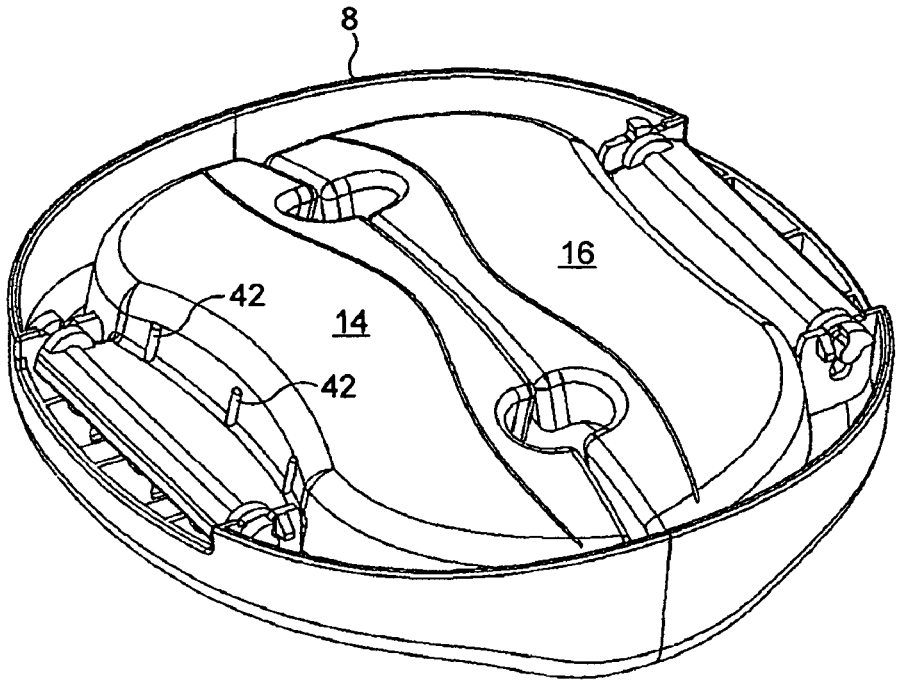
FIG. 5 is a perspective view of the device of FIG. 2 from below.
Figure 6:
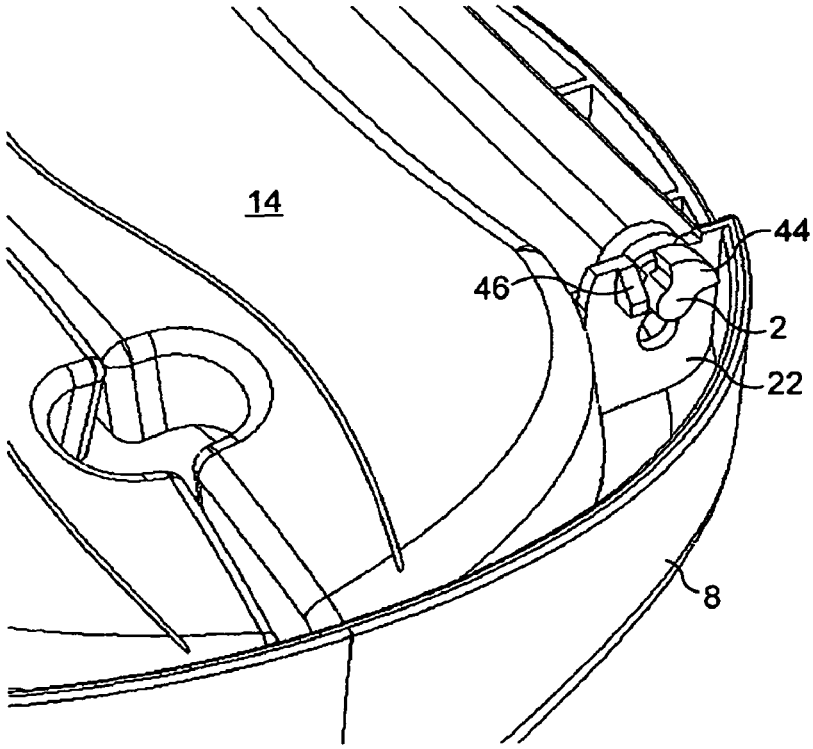
FIG. 6 is a perspective view to an enlarged scale of a detail of FIG. 5.
Figure 7:
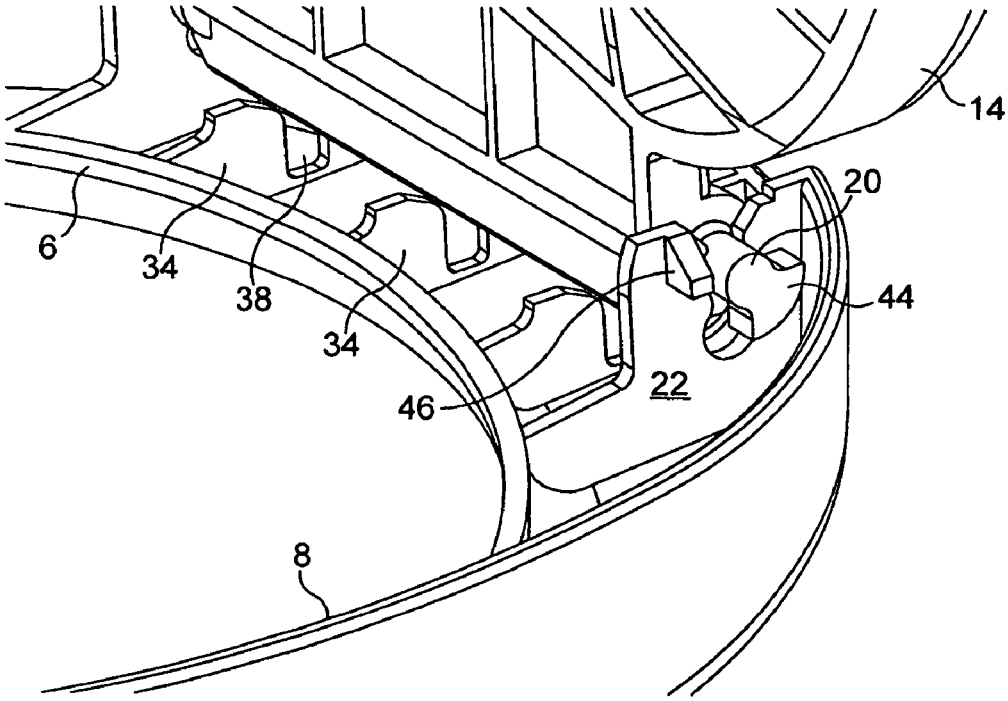
FIG. 7 is a perspective view of an enlarged scale of a detail of the device in the free standing potty configuration but from below.

As shown in FIGS. 1 to 5 the device comprises a generally annular body or seat 2 having a profiled seating surface surrounding a central opening 4. The annular body has an inner and outer downwardly depending skirts 6 and 8: the outer skirt 8 having a greater drop than the inner skirt 6. The profiled seating surface of the annular body 2 has raised protuberances 10 and 12 at diametrically opposite ends to define the front and rear such as in conventional chamber pots for children.

The seat 2 is supported at opposite sides by a pair of similar side walls 14 and 16.

The side walls 14 and 16 are coupled to the annular body 2 between the inner and outer skirts 6 and 8 and can occupy one of three defined configurations. These three configurations are a substantially erect configuration (see FIG. 1) where the annular body 2 is supported spaced from the floor on which the side walls 14 and 16 are rested; a folded configuration where the side walls 14 and 16 are folded into an area bounded by the outer skirt 8 and extend across the opening 4 and a toilet seat adaptor configuration where the side walls 14 and 16 extend outwardly from the outer skirt 8 and lie generally coplanar with the seat 2.

The seat is arranged to be used as a childrens chamber pot when in the erect configuration together with container in the form of a plastic bag with handles. In use the plastic bag (not shown) is placed in the opening 4 and the handles are brought out over the top of the seat and caused to engage a pair of spaced recesses 14*a*, 14*b* and 16*a*, 16*b* in the distal ends of respective side walls 14 and 16.

Figure 10:
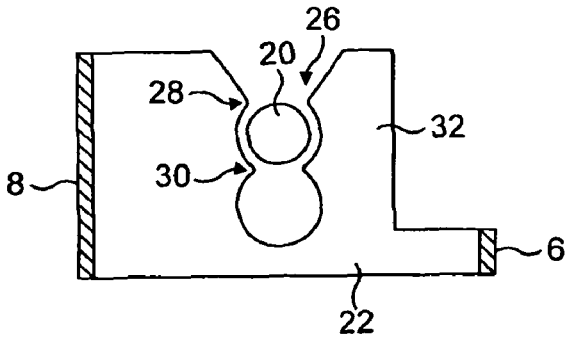
FIG. 10 is a detail of the hinge mechanism of the device.
Figure 11:
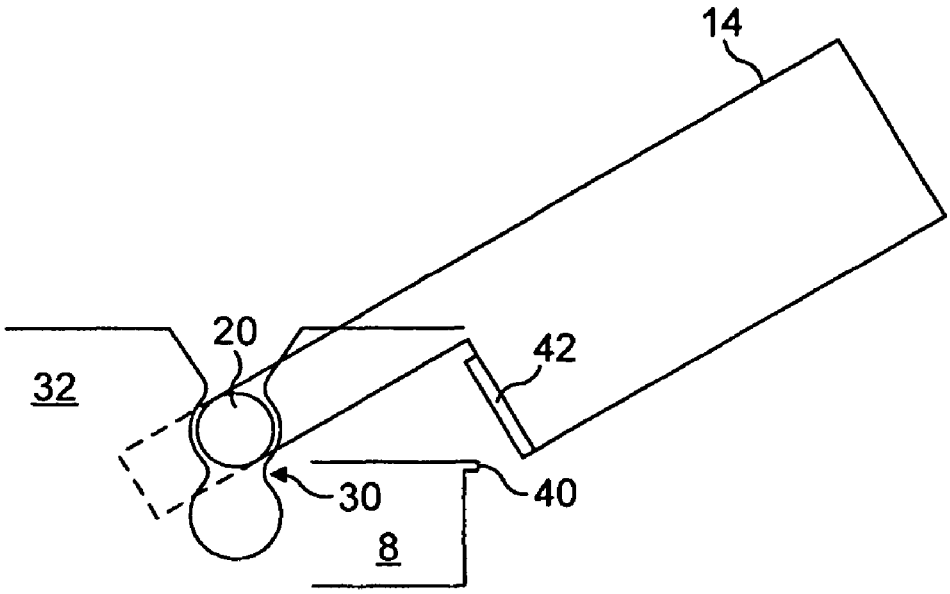
FIGS. 11 and 12 are front elevations of a detail of the hinge mechanism and one of the legs of the device.

Each side wall 14 and 16 has an integral rod 20 which projects from opposite ends and is supported by a pair of spaced support flanges 22 and 24 extending between the inner and outer skirts 6 and 8. The description which follows will be directed to the side wall 14 but it applies equally to the side wall 16. As can be more clearly seen in FIG. 10, the support flange 22 is provided with a profiled slot which is engaged by the rod 20. The slot has two spaced necked portions 28 and 30 each defining a gap slightly smaller than the diameter of the rod 20 and two spaced circular regions each sized to accommodate the rod 20. Also because the skirt 6 is less extensive than the skirt 8, the slot defines in the flange a finger 32 which can flex more readily than the rest of the flange. By forcing the rod 20 along the slot from one circular region to the other the rod can be moved between two stable locations namely an upper location (as shown in FIG. 10) and a lower location. In its upper stable location the side wall 14 can be moved from the folded configuration through to the toilet seat adaptor configuration.

Figure 8:
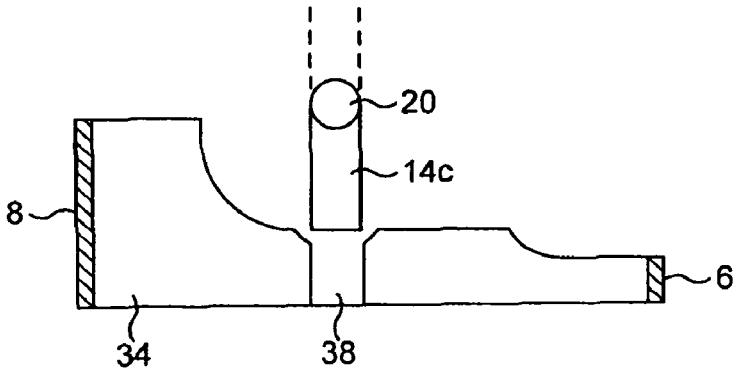
FIGS. 8 and 9 are front elevation views of a detail of the device when in the folded away and in the free standing configurations.

Between the two spaced support flanges lies a series of locking flanges 34. Each locking flange extends between the inner and outer skirts 6 and 8 (see FIGS. 8 and 9). Each locking flange 34 has a slot 38 which is aligned with a tail portion 14*c* of the side wall 14 when in the erect configuration.

These locking flanges 34 prevent the rod 20 from being displaced along the slot 26 except when the side wall is in the erect configuration. However, when the side wall is in the erect configuration pressure can be applied to the side wall 14 to displace the rod from the upper stable location to the lower stable location against the resilience of the finger 32. When this happens the tail portion 14*c* engages the slots 38 in the flanges 34 and this locks the side wall 14 in the erect position and prevents the rod 20 from rotating about its axis.

Pulling the side wall 14 away from the seat portion will move the rod 20 from the lower stable position to the upper stable position against the resilience of the finger 32.

Figure 9:
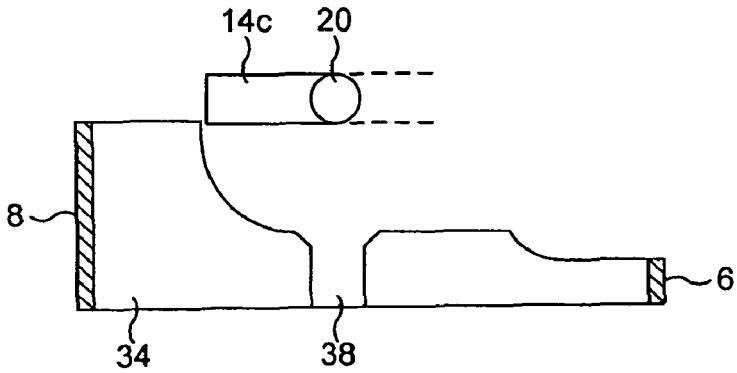

The flanges 34 also act as a detent mechanism to locate the side wall in either the erect or folded configuration. As shown in FIG. 9 the profile of the flange 34 on opposite sides of the slot 38 intersects with the locus of the distal end of the tail portion 14*c* of the side wall 14. Two locations where there is no interference occur when the side wall is either in the folded configuration (see FIG. 9) or the erect configuration (see FIG.

8). To move from the folded to the erect configuration the engaging surfaces of the tail portion 14*c* and the flange 34 will displace the rod against the resilience of the finger 10.

The detent mechanism for constraining the side wall 14 in the toilet seat converter configuration is provided by a series of spaced ribs 42 (see FIG. 5) on the side wall 14 which engage a flange 40 projecting outwardly from a recessed portion in the outer skirt 8. As the side wall 14 is moved from the erect position towards the toilet seat converter configuration, the ribs 42 engage the flange 40 and since the flange lies below the axis of the rod when in the upper stable position it causes the rod 20 to move upwardly in the slot 26 against the resilience of the flange 32.

Figure 12:
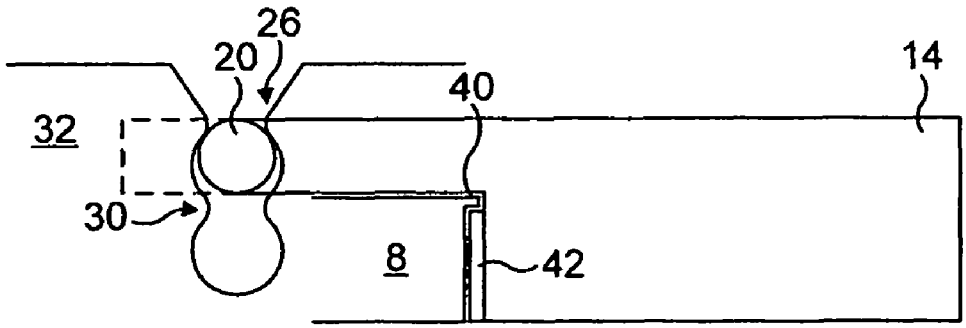

Continued engagement with the flange occurs until the ends of the ribs 42 pass the flange 40 (see FIG. 12) and drop into a slot formed between the ends of the ribs 42 and a surface of the side wall. At this point the flange 32 resiles and the side wall 14 is in effect located in the toilet seat converter configuration.

A stop mechanism is provided to augment the detent mechanism. The stop mechanism takes the form of an arcuate projection 44 extending radically from one end of the rod 20 which engages a stop 46 projecting from the adjacent flange 22. A similar stop mechanism is provided at the opposite end of the rod 20.

Each side portion 14 and 16 has a generally semicircular skirt 50 surrounding a generally semicircular outer face 52. A grid of intersecting flanges 54 extends across the skirt 50 to provide reinforcement (see FIG. 4), and render the side portions rigid.

The free ends of the flanges 50 and the skirt 50 may be lined with a non slip rubber or silicone rubber layer so as to prevent the device slipping when placed on a toilet seat in the toilet seat adaptor configuration. The ground engaging surfaces of the side walls may also be so lined. The lining may be glued, molded or otherwise secured to the device which is preferably made of polypropylene.

Since the resilience of the finger 32 plays an important part in the device its preferred dimensions are; thickness in the range of 1 to 3 mm and width in the range of 4 to 8 mm.

It will be appreciated that when the device is made of a plastics such as polypropylene some flexure of the seat portion can occur when the device is in the toilet seat converting configuration. This ensures a more even contact of the intersecting flanges with the toilet seat thus ensuring a better grip of the device on the seat.

It will further be appreciated that by using the same device for toilet training children away from a regular toilet and then using the device as a adapter for a conventional toilet seat the toddler or child will be able to make the transition with a greater degree of comfort and security, not only physically but emotionally.

The invention claimed is:

1. A toilet device comprising a seat portion, a pair of side walls pivotally secured to opposite sides of the seat portion so that the side walls can be displaced from a first folded configuration in which they extend inwardly towards each other, through a second erect configuration in which they extend generally at right angles to the seat portion to a third toilet seat adapting configuration in which they extend generally away from one another, locking means for locking the side walls to the seat portion in the second configuration and stop means for preventing the side walls from pivoting beyond the third configuration, wherein said seat portion comprises an annular body having inner and outer downwardly depending skirts, wherein each said side wall is supported by a rod and includes for each side wall a pair of spaced support flanges extending between the inner and outer skirts and rotationally supporting a respective rod and each side wall further includes a pair of spaced recesses towards distal ends thereof capable of being engaged by handles of a plastic bag when the side walls are in the second erect configuration, wherein each support flange includes a profiled slot, extending substantially at right angles to the seat portion and having first and second spaced enlarged areas sized to accommodate the rod, the rod being displaceable from one enlarged area to the other through a gap normally narrower than the diameter of the rod by virtue of the resilience of the flange.

2. A device according to claim 1, including means for locking said side walls in said third configuration.

3. A device according to claim 1, including detent means for locating said side walls in each of said first and second configuration.

4. A device according to claim 1 wherein the toilet seat engaging faces of the side walls are lined with a non-slip material.

5. A device according to claim 4 wherein said non-slip material is silicon rubber or rubber.

6. A device according to claim 1, including a plurality of locking flanges extending between the inner and outer skirts, each locking flange having a slot for receiving a portion of the side wall when the side wall is in the second configuration in response to displacement of the rod of the side wall from a first said enlarged area of the slot to a second said enlarged area thereby locking the side wall against rotation about the axis of the rod.

7. A device according to claim 6, wherein in moving a side wall from said first to said second configuration said locking flanges define an interference fit with the side wall and so cause the support flange to resile, the locking flanges being free of such an interference fit at the first and second location to thus define detent locations for said first and second configurations.

8. A device according to claim 1 wherein each said side wall has an outer surface which abuts the outer face of the outer skirt when in the third configuration whereby to resist displacement of said side wall beyond the third configuration.

9. A toilet device comprising a seat portion, a pair of side walls pivotally secured to opposite sides of the seat portion so that the side walls can be displaced from a first folded configuration in which they extend inwardly towards each other, through a second erect configuration in which they extend generally at right angles to the seat portion to a third toilet seat adapting configuration in which they extend generally away from one another, locking means for locking the side walls to the seat portion in the second configuration and stop means for preventing the side walls from pivoting beyond the third configuration, wherein said seat portion comprises an annular body having inner and outer downwardly depending skirts, wherein each said side wall is supported by a rod and includes for each side wall a pair of spaced support flanges extending between the inner and outer skirts and rotationally supporting a respective rod, wherein each said side wall has an outer surface which abuts the outer face of the outer skirt when in the third configuration whereby to resist displacement of said side wall beyond the third configuration, wherein said outer surface of each side wall carries a plurality of spaced ribs which engage an outwardly projecting rim from said skirt as the side wall approaches the third configuration against the resistance of the supporting flanges, whereby when the ribs clear the rim the resilience of the supporting flanges locks the rim in the gap between the said outer face and said ribs.

10. A device according to claim 1 wherein the ground engaging surfaces of the side walls are lined with non-slip material.

* * * * *